United States Patent [19]

Wagner

[11] 3,963,072

[45] June 15, 1976

[54] DOUBLE-FLOW REGENERATOR

[75] Inventor: Norbert Wagner, Schlederloh, Wolfratshausen, Germany

[73] Assignee: Linde Aktiengesellschaft, Wiesbaden, Germany

[22] Filed: Nov. 21, 1974

[21] Appl. No.: 526,007

[30] Foreign Application Priority Data

Nov. 22, 1973 Germany ..... 2358276

[52] U.S. Cl. ..... 165/157; 62/13; 165/9.3

[51] Int. Cl.[2] ..... F28D 7/10

[58] Field of Search ..... 165/157–161, 165/145, 156, 163, 140, 141, 143, 9.3; 62/13, 14; 122/32, 34, 510

[56] References Cited

UNITED STATES PATENTS

| | | | |
|---|---|---|---|
| 3,256,932 | 6/1966 | Schlichting | 165/163 |
| 3,398,789 | 8/1968 | Wolowodiuk et al. | 165/158 |
| 3,433,298 | 3/1969 | Vollhardt | 165/157 |
| 3,446,188 | 5/1969 | Nozawa et al. | 165/163 |

FOREIGN PATENTS OR APPLICATIONS

| | | | |
|---|---|---|---|
| 991,915 | 5/1965 | United Kingdom | 165/157 |

*Primary Examiner*—Charles J. Myhre
*Assistant Examiner*—Theophil W. Streule, Jr.
*Attorney, Agent, or Firm*—Karl F. Ross; Herbert Dubno

[57] ABSTRACT

A double-flow regenerator has several separate groups of tubes each of which is used for a respective fluid heat-exchange medium. These tubes are all received in a packed housing through which fluids to be treated are passed in heat-exchange relationship with the packing in the housing through the tubes in contact with this packing. Each group of tubes terminates within the housing at each end of a plurality of separate manifold connectors. Thus the middle of the housing is provided with a plurality of manifolds for the inner end of each tubing group and the outer end is provided with a plurality of such manifolds for each group, with several such manifold connectors provided for each group for minimum variation in tube lengths within the group.

2 Claims, 3 Drawing Figures

DOUBLE-FLOW REGENERATOR

FIELD OF THE INVENTION

The present invention relates to a regenerator. More particularly this invention concerns such a regenerator using tube groups or bundles for indirect heat exchange between the various heat-exchange media.

BACKGROUND OF THE INVENTION

Regenerators are known having at each end several manifold collectors each secured to the respective ends of a respective group of tubes that are in turn each used for a respective fluid medium. Thus if two media are used, there will be two such manifold connectors at each end of the regenerator. The tubes generally run along the central axis of the regenerator and are welded or soldered at their ends to the respective manifold connectors.

Such a regenerator has the considerable disadvantage that the tubes of each group or bundle vary considerably in length. This is due to the fact that it is not possible to bring all of the tubes for a given medium out of the bundle at the same cylindrical height if they are to be manifolded together at one spot. These different tube lengths create different flow resistances in the different tubes of the bundle and therefore create different temperature differences. Thus only a few of the tubes of each bundle or group are connected directly at their ends to the manifold connectors. The temperature difference between the medium in the tubes and thereround is frequently relatively great.

OBJECTS OF THE INVENTION

It is therefore an object of the present invention to provide an improved regenerator.

Yet another object is the provision of such a regenerator whose flow-resistance and heat-exchange characteristics vary less from tube to tube than in the type described above.

SUMMARY OF THE INVENTION

These objects are attained according to the present invention in a generator wherein each of the fluid media is distributed to its tubes through a plurality of separate peripherally or angularly spaced manifold connectors. The use of several manifold connectors for a single medium instead of a single large manifold connector on each end allows the tubes to be laid out relatively close to the theoretical end of the tube group and from there they need be diverted only a short distance to the respective manifold connectors. The differences in the lengths of the single tubes is thus reduced substantially so that a better flow distribution and a more uniform resistance to flow is obtained. Only very small heat-exchange losses are produced.

According to yet another feature of this invention the manifold connectors for each medium are peripherally and/or angularly spaced about the axis of the regenerator. In a regenerator of the double-flow type in accordance with the present invention the manifold connectors for the neighboring tubing groups or bundles are fully distinct and separate from one another. In this manner the two halves of the double-flow regenerator can be manufactured separately. To this end it is not necessary to provide a single core tube or central axial conduit around which the tubing is wound and for which a relatively great resistance is necessary so that the core tube is very thick or must be made with relatively larger diameter. In addition to this the core tube and the winding arrangement must have double the overall length as for simple single-flow type regenerators.

It is thus possible to wind or wrap each group of tubings for the double-flow regenerator separately in such a manner that the bundles are held at the warm upper and lower ends of the housing. The two core-tube ends are connected together with a sleeve that is carried on one of them and which serves to guide the end of the other core-tube half. Thus it is possible for the assemblies to deform thermally on heating and cooling. It is also within the scope of this invention to weld the two core tubes together after assembly of the two bundles being held jointly, for example, in the cool middle of the assembly with expensive low-temperature resistant material. The use of several manifold connectors instead of a single large manifold also gives the central region of the regenerator a desirably simplified structure such that it is possible to produce a double-flow regenerator of relatively reduced cost.

In accordance with another feature of this invention the manifold connectors are arranged in the wall of the regenerator and are joined together outside the regenerator by means of manifolds. It is also within the scope of this invention to provide the manifold connectors inside the regenerator and connect them to the outside via short conduits. This arrangement is particularly advantageous when used in connection with double-flow regenerators.

The use of the generator according to the present invention is extremely advantageous in that it allows a considerable capacity to be obtained in a relatively limited volume. It is also possible with the system according to the present invention to allow pure products to flow through the tube bundles.

BRIEF DESCRIPTION OF THE DRAWING

The above and other objects, features, and advantages will become more readily apparent from the following, reference being made to the accompanying drawing in which.

SPECIFIC DESCRIPTION

Figures 1A, 1B:
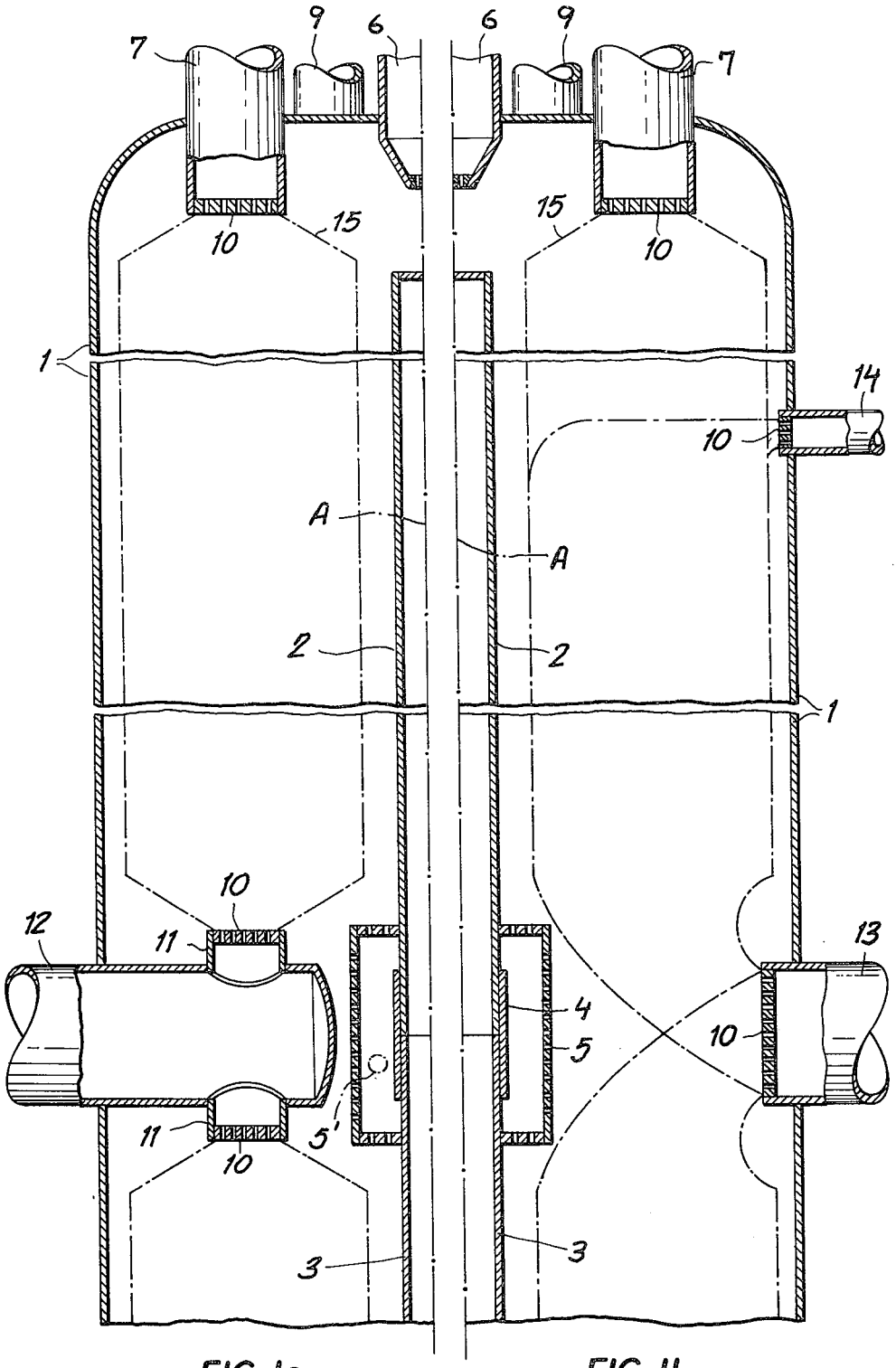
FIGS. 1*a* and 1*b* are vertical sections through two regenerators according to the present invention.
Figure 2:
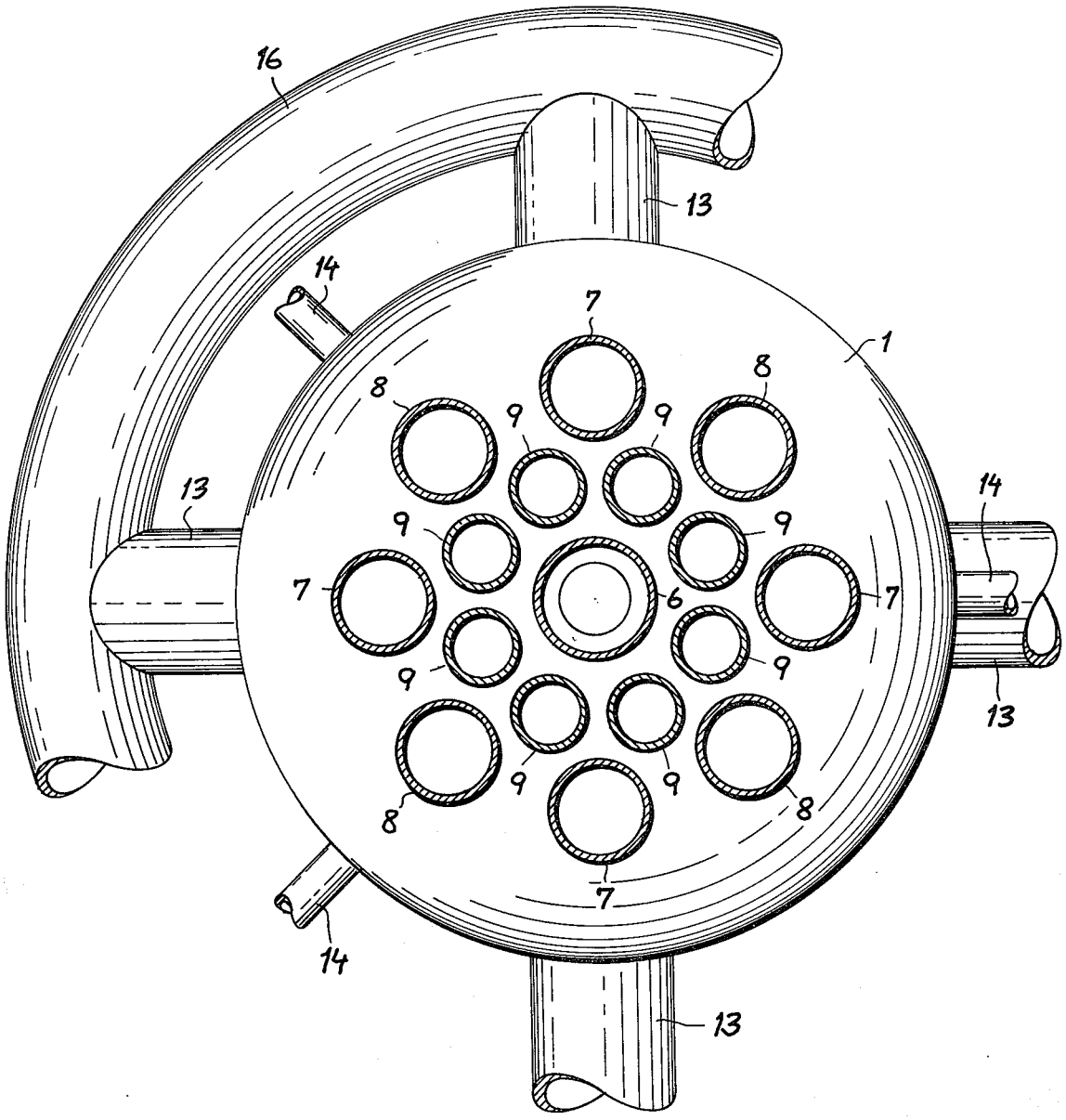
FIG. 2 is a top view of a regenerator substantially as shown in FIG. 1*b*.

As shown in the Figures, a housing 1 of a regenerator is packed with a conventional regenerator packing 12. Inside the housing 1 is an upper core tube 2 for the upper half of the regenerator and a lower core tube 3 for the lower half of the regenerator with their ends abutting. Core tubes 2 and 3 are joined at the middle of the regenerator by a sleeve 4. This sleeve 4 is surrounded by a perforated compartment 5 through which, for example, a warming medium is fed by a conduit indicated at 5' so as to flow from the middle towards the ends of the regenerator where it is drawn off through axial conduits or nipples 6 such that when the regenerator is switched over the cooling medium is fed in at the axial inputs 6 and drawn out at the perforated compartment 5 through the conduit 5'.

Other fluid media which take part in the heat exchange are used in this regenerator and are passed through tubes in heat-exchange contact with the regenerator packing as described in commonly assigned U.S.

Pat. No. 3,364,686. These tubes as indicated at 15 are laid out in bundles wound around the core tubes 2 and 3 with the length and type of tubing established for each medium.

In both the embodiments shown in FIGS. 1*a* and 1*b* the top of the housing 1 is provided with connecting conduits 7, 8, and 9 each of which is provided with a respective manifold connector 10. The four conduits 7 serve for a common fluid medium, the four conduits 8 serving for another fluid medium and the eight conduits 9 for yet another. Thus a plurality of such manifold connectors 10 are provided for each of the media. Conduits 7, 8, and 9 can serve to introduce the respective fluid medium or to draw it off.

In the middle of the double-flow regenerator according to the present invention the tubing groups for each medium are spaced radially from one another relative to the axis A of the regenerator. The arrangement shown in FIG. 1*a* the tubing bundles 15 are connected at the center of the regenerator to further manifold connectors 10 lying in planes perpendicular to the axis A and connected to conduits 11 which are mounted on radially extending conduits 12 projecting from the middle of the housing 1. In FIG. 1*b* radially extending conduits 17 are used which are provided just inside the wall of the housing 1 with manifold connectors 10 lying parallel to the axis A. The tubing bundles 15 are soldered or welded to the manifold connectors 10. The tubes of the bundles can be separate from one another and arranged one over or under the other. It is also possible to terminate the bundles at a location short of the top of the housing and manifold connectors 10 carried in radial conduits 14 projecting radially from the housing 1 as do conduits 13. A manifold 16 connects the conduits 13 outside the housing 1.

Accessability for soldering or welding the manifold pieces 10 to the conduits 12 is gained in that the conduit 5' for the medium introduced into the regenerator packing is only mounted along with the perforated compartments 5 at the end of the assembly operation. This compartment 5 is mounted after assembly of the two halves of the regenerator and the welding of the manifold connectors 10 so as to create working space within the assembly.

The collector conduit for one of the media can also be mounted within the housing 1 and formed as an annular collector tube so long as it does not interfere with the other media and auxiliary media. In this case each of the tubes traversed by an auxiliary media is soldered into the respective manifold tube so as to give the maximum possible number of manifold connectors 10 for the tubes of each bundle.

In a working model of a double-flow regenerator according to the invention the central part is the cold regenerator portion. Air is introduced through the conduits 6 and is drawn out of the apparatus through the perforated compartment 5 and the conduit 5' after it is cooled. When switched around impure nitrogen is introduced into the regenerator as a medium by the conduit 5' and is then warmed and drawn off at the conduit 6. With this arrangement the auxiliary media passing through the tubes 15 were oxygen, impure oxygen, and turbine air which were fed over the connections 12, and 13 with manifold connectors 11 into the tube bundles and drawn out over conduit 7, 8, 9, and 14 having respective manifold connectors at 10. The number of tubes, manifold connectors 10, and conduits 7, 8, 9, 12, 13, and 14 depends on the relative proportions of the media being used.

I claim:

1. A double-flow regenerator for a gas-rectification plant adapted to pass a multiplicity of fluids into mutual indirect heat exchange, said regenerator comprising:

an elongated housing having opposite ends;

a core tube extending longitudinally through said housing centrally thereof;

a pair of coiled-tube bundles axially spaced apart in said housing and surrounding said core tube, each of said bundles comprising a plurality of coiled tubes, the coiled tubes of said bundles constituting the only heat-exchange tubes extending within said housing;

a regenerator packing filling said housing around said tubes;

a plurality of conduits at each end of said housing, each conduit communicating with a plurality of coiled tubes of a respective bundle for conducting a respective one of said fluids the conduits at each end being spaced around the axis of said housing;

respective manifolds between said bundles communicating with the tubes thereof for each fluid and leading out of said housing through a side wall thereof; and duct means connected to said housing at the ends thereof and between said stacks for passing a further fluid through said packing.

2. The double-flow regenerator we find in claim 1 wherein said duct means comprise a perforated compartment disposed centrally within said housing and a conduit extending into said compartment, and respective ducts opening into the space around said core tube at each end of said housing.

* * * * *